United States Patent [19]

Corsmeier et al.

[11] Patent Number: 4,890,981

[45] Date of Patent: Jan. 2, 1990

[54] BOLTLESS ROTOR BLADE RETAINER

[75] Inventors: Robert J. Corsmeier, Cincinnati; Ronald E. Schlechtweg, Loveland; Richard W. Albrecht, Jr., Fairfield; Dennis P. Dry, Cincinnati, all of Ohio

[73] Assignee: General Electric Company, Cincinnati, Ohio

[21] Appl. No.: 292,084

[22] Filed: Dec. 30, 1988

[51] Int. Cl.[4] ..... F01D 5/32

[52] U.S. Cl. ..... 416/220 R; 416/95

[58] Field of Search ..... 416/219 R, 220 R, 221, 416/193 A, 95

[56] References Cited

U.S. PATENT DOCUMENTS

| | | | |
|---|---|---|---|
| 2,755,063 | 7/1956 | Wilkinson | 416/220 R |
| 2,998,959 | 9/1961 | Haworth et al. | 416/221 |
| 3,096,074 | 7/1963 | Pratt et al. . | |
| 3,768,924 | 10/1973 | Corsmeier et al. | 416/95 |
| 3,814,539 | 6/1974 | Klompas | 416/218 X |
| 3,888,601 | 6/1975 | Glassburn | 416/193 A X |
| 4,171,930 | 10/1979 | Brisken et al. | 416/220 |
| 4,192,633 | 3/1980 | Herzner | 416/221 |
| 4,304,523 | 12/1981 | Corsmeier et al. | 416/221 |
| 4,344,740 | 8/1982 | Trenschel et al. | 416/193 A X |
| 4,432,555 | 2/1984 | Langley | 416/193 A X |
| 4,470,756 | 9/1984 | Rigo et al. | 416/220 R |
| 4,507,052 | 3/1985 | Thompson | 416/220 R X |
| 4,767,276 | 8/1988 | Barnes et al. | 416/220 R |

*Primary Examiner*—Everette A. Powell, Jr.

*Attorney, Agent, or Firm*—Jerome C. Squillaro; Steven J. Rosen

[57] ABSTRACT

A boltless blade retainer for preventing forward axial movement of the rotor blades in a turbo machine relative to the rotor disk comprises an annular extension or hook formed on each dovetail post on the web of the rotor disk, an impeller or blade retainer formed with a flange which is carried against the web and dovetail posts and a retaining ring interposed between the hooks of the dovetail posts and the flange of the impeller. The retaining ring secures the impeller in a fixed axial position relative to the dovetail posts and rotor disk, and is positioned to engage the rotor blades carried in the axial slots between adjacent dovetail posts to prevent their movement in a forward axial direction.

14 Claims, 5 Drawing Sheets

BOLTLESS ROTOR BLADE RETAINER

The government has rights in this invention pursuant to Contract No. F33657-83-C-0281 awarded by the Department of Air Force.

FIELD OF THE INVENTION

This invention relates to turbo machinery rotor construction, and, more particularly, to structure for axially retaining the rotor blades on the rotor disk of a turbo machine.

BACKGROUND OF THE INVENTION

Turbo machinery such as high performance gas turbine engines have a compressor and turbine which each include one or more annular banks or rows of axially spaced fixed stator vanes which are positioned between rows of rotatable rotor blades. Each rotor blade is formed with a rotor tip, an air foil and dovetail-shaped base or root which mounts within a mating, axial slot formed between adjacent dovetail posts on the web or rim of the rotor disk. The connection between the dovetail root of the rotor blade and the axial slot between adjacent dovetail posts in the rotor disk prevents radial and tangential movement of each rotor blade relative to the rotor disk.

In order to prevent axial movement of the rotor blades, i.e., along the longitudinal axis of the rotor disk and engine, one or more blade retainers are mounted adjacent the axial slots in the rotor disk. These blade retainers must be secured to the rotor disk to maintain the rotor blades in place and yet be easily removable in order to replace the rotor blades.

The most common method of securing blade retainers to the rotor disk is to employ bolts and nuts which are circumferentially spaced about the rotor disk. Bolts provide a strong connection between the blade retainers and rotor disk, but a number of problems are presented. The bolt holes formed in the blade retainer and rotor disk create localized stress areas which reduces the cyclic life of such parts. This is particularly true in view of the high temperatures and high speeds at which the rotor disks and rotor blades are operated within high performance gas turbine engines.

In order to reduce such localized stresses, some prior art designs have incorporated additional material in the areas where the bolt holes are formed on both the blade retainers and the rim of the rotor disk. Although this tends to reduce localized stresses, such addition of material increases the overall weight of not only the blade retainers, but the rotor disk. Moreover, the high strength forgings which are used to fabricate the blade retainers present a difficult machining operation typically requiring the use of electrochemical machining.

The use of bolts to secure axial blade retainers to the rotor disk also presents installation and performance problems. A relatively large number of circumferentially spaced bolts and nuts must be installed to mount the blade retainers in place, and then removed to replace rotor blades. Additionally, the bolts must be carefully torqued in order to avoid overstress at the connection which also increases installation time. Bolt heads and nuts which protrude from the rim of the rotor disk increase the temperature of the surrounding air and create a disturbance of the air flow passing across the disk, i.e., "windage", both of which result in decreased engine performance.

In recognition of the problems identified above, boltless blade retainers have been developed such as disclosed, for example, in U.S. Pat. Nos. 3,768,924 to Corsmeier et al; 4,171,930 to Brisken et al; and, 4,304,523 to Corsmeier et al, all assigned to of the type disclosed in these patents, and others, reduce the problems of localized stress concentration in the rotor disk rim and blade retainers, reduce installation time and difficulty, reduce the weight of the blade retainers and rotor disks and, in some cases, reduce cost. Nevertheless, some problems have yet to be overcome.

For example, in some designs such as shown in U.S. Pat. No. 3,768,924, boltless blade retainers are formed with a plurality of tabs on a radially inner portion thereof which interlock with a plurality of slots machined on the rotor disk. This arrangement provides an effective means to secure the blade retainer to the rotor disk, but the fabrication of the tabs and slots requires a relatively large amount of machining which can increase costs.

Other types of blade retainers such as shown in U.S. Pat. No. 4,171,930 employ clips or shear wires to secure the blade retainer to the rotor disk. While also effective in providing a secure connection between the blade retainer and disk, such clips or wires often protrude into the air flow through the compressor or turbine of a turbo machine. This can create a windage problem and also increase the temperature of such air, thereby reducing engine performance.

It is therefore preferable to remove the structure which secures the blade retainer to the rotor disk from the path of air passing through the compressor or turbine of the turbo machine. As shown, for example, in U.S. Pat. No. 4,304,523, boltless blade retainers have been designed which are held in place by a retaining member carried within a recess or slot formed in the rotor disk. The retaining member is wedged within the recess between the blade retainer and a portion of the rotor disk so that the blade retainer is held in an axially fixed position relative to the rotor disk.

While boltless blade retainers of the type described in U.S. Pat. No. 4,304,523 have the advantage of reducing windage effects, in such designs the retaining member must be moved to a seated, locked position with respect to the blade retainer and rotor disk in order to ensure that the blade retainer is securely locked in place on the rotor disk. No fail-safe structure is provided to ensure that the retaining member has been moved to a locked position, and thus it is possible that the blade retainer could be held in position but not locked in place if the assembly operation is not performed correctly.

SUMMARY OF THE INVENTION

It is therefore among the objectives of this invention to provide a boltless blade retainer for the rotor blades of a turbo machine which maintains the rotor blades in an axially fixed position relative to the rotor disk, which reduces windage effects, which is lightweight, which is easy to assemble or disassemble, which has a fail-safe feature to require proper assembly of the rotor blade to the rotor disk and which is capable of maintaining the blade retainer or impeller in position even if a failure occurs.

These objectives are accomplished by blade retention structure comprising an annular extension or hook formed on each disk dovetail post on the web of the rotor disk. The hook on each dovetail post extends radially inwardly toward the hub of the rotor disk and is spaced from the body of the dovetail post forming a cavity therebetween. An annular blade retainer or impeller has an inner end carried on the web of the rotor disk, and an outer end which is adapted to contact one edge of each rotor blade mounted in the axial slot between adjacent dovetail posts of the rotor disk. The impeller has a radially outwardly extending flange which is positioned within the cavity formed by the hook of the dovetail posts and is spaced from the hooks. A retaining ring is interposed between the hook of the dovetail post and the flange of the impeller so that the impeller is axially fixed with respect to the dovetail posts, thus restraining the rotor blade from axial movement relative to the rotor disk.

This construction has a number of advantages over the prior art. The cavity formed between the annular hook of the dovetail posts and the web of the rotor disk substantially encloses the retaining ring to reduce or eliminate any windage effects. The retaining ring is further isolated from air passing through the turbo machine by the impeller which has an outer end located on one side of the retaining ring. The dovetail post hook, impeller and blade dovetail base enclose the retaining ring to such an extent that even if the retaining ring failed and broke into two or more pieces, these pieces would be held in place between the hooks of the dovetail posts, the blade dovetail base and flange of the impeller to maintain the impeller in position with respect to the rotor disk. In one embodiment herein, the retaining ring is surrounded by still additional structure to hold it in place in the event of a failure; namely, an extension formed on the root of each rotor blade located aft of the retaining ring, and a slot formed in the impeller having a forward surface which encloses a forward portion of the retaining ring.

In the presently preferred embodiment, the retaining ring is an annular, U-shaped member having parallel legs. One leg of the U-shaped retaining ring is positioned between the facing surfaces of the hook on the dovetail posts of the rotor disk and the flange of the impeller to prevent axial movement of the impeller with respect to the rotor disk. The other leg of the U-shaped retaining ring rests atop a portion of the impeller for ease of assembly and disassembly.

The U-shaped retaining ring also provides a fail-safe feature to ensure the assembly operation is performed correctly. The length of the two legs forming the U-shaped retaining ring is such that unless the retaining ring is located in a seated, locked position with respect to the dovetail posts and impeller, it will interfere with the dovetail base or root of a rotor blade inserted within the axial slot between adjacent dovetail posts. That is, the U-shaped retaining ring extends into the path of a rotor blade inserted within the axial slot between dovetail posts of the rotor disk unless the retaining ring is completely seated between the hook of the dovetail post and flange of the impeller. This feature eliminates operator error in the installation of the impeller onto the rotor disk.

In the presently preferred embodiment, the retaining structure of this invention is located on the forward side of the dovetail posts to restrain the rotor blades from axial movement in a forward direction. To mount the impeller or other blade retainer onto the forward side of the dovetail posts, the assembly operation proceeds as follows. The retaining ring is first positioned within the cavity formed between the hook and body portion of each dovetail post. The impeller is then positioned on the rotor disk such that its upper end is located in a position to engage the root of a rotor blade and its flange faces the hook portion of the dovetail posts within the cavity between the hook and web of the rotor disk. The U-shaped retaining ring is then moved radially inwardly toward the hub of the rotor disk so that one of its legs extends between the facing surfaces of the hook and flange, and the other leg rests atop a portion of the impeller. In this seated, locked position of the retaining ring, the rotor blades can then be inserted into each axial slot between adjacent dovetail posts and against the impeller which is axially fixed to the rotor disk.

The opposite, aft side of the rotor blade is held in place by structure such as disclosed in U.S. Pat. No. 4,304,523 to Corsmeier et al. This same structure can also be employed to mount the lower end of the impeller to the rotor disk.

DESCRIPTION OF THE DRAWINGS

The structure, operation and advantages of the presently preferred embodiment of this invention will become further apparent upon consideration of the following description, taken in conjunction with the accompanying drawings, wherein.

DETAILED DESCRIPTION OF THE INVENTION

Figure 1:
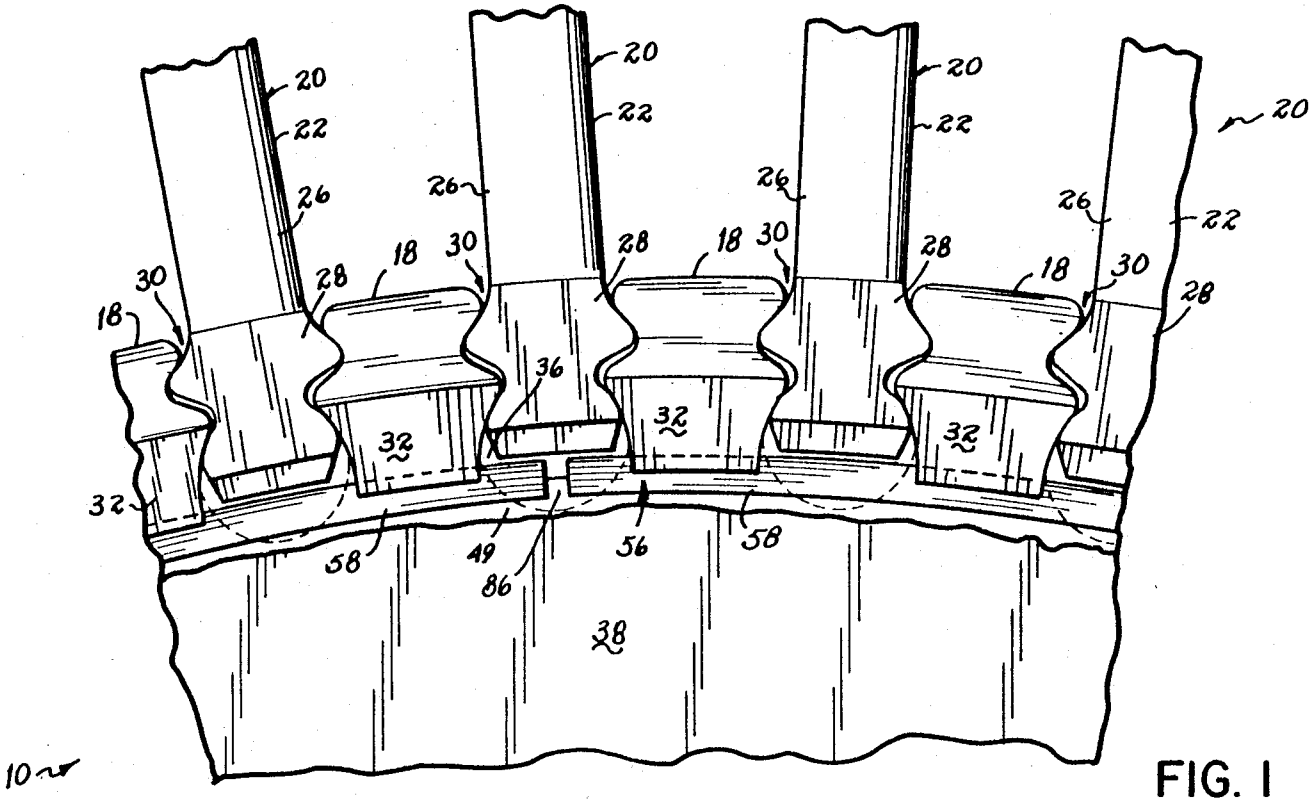
FIG. 1 is a schematic, elevational view looking at several rotor blades and rotor disk in an aft direction.
Figure 2:
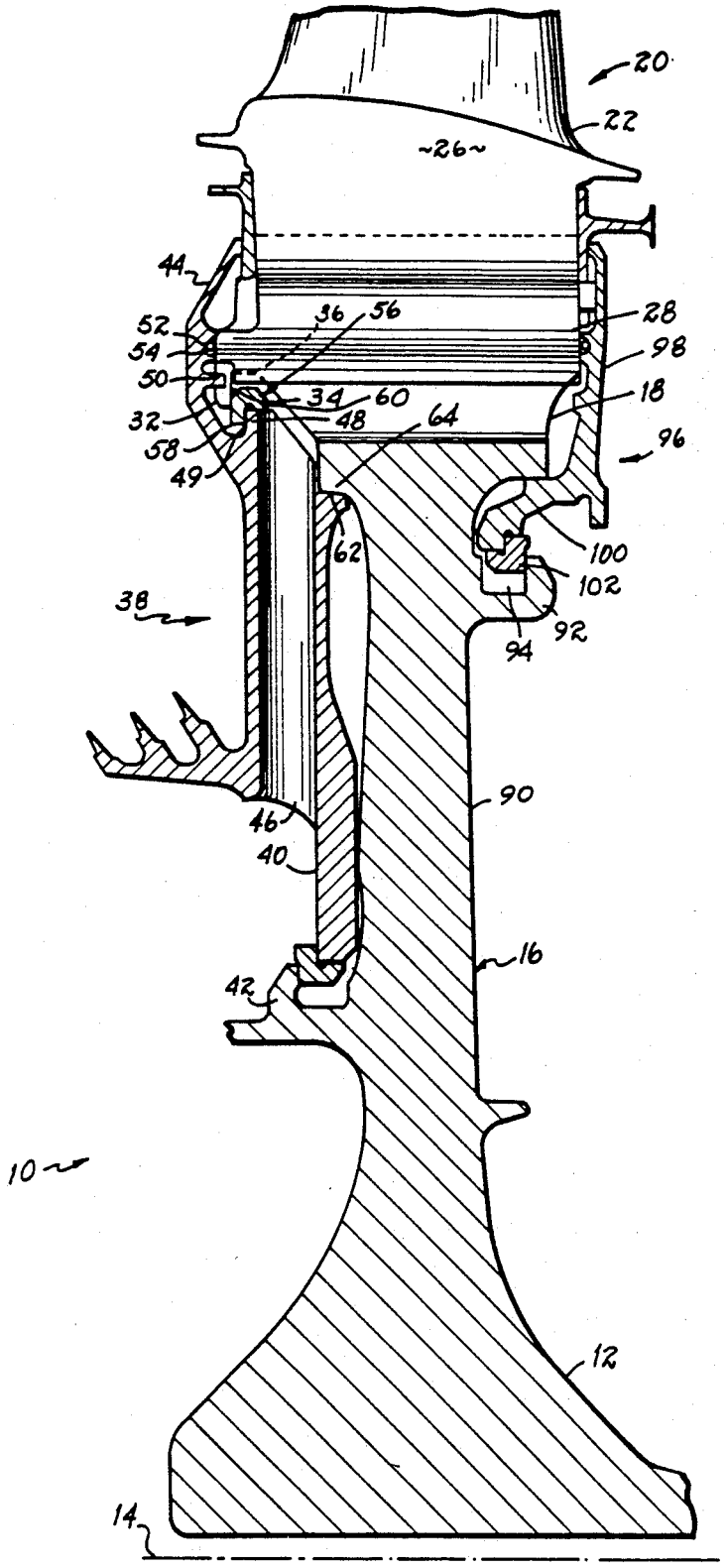
FIG. 2 is an elevational view in partial cross section of the connection between the impeller, rotor disk and one rotor blade.

Referring now to FIGS. 1 and 2, a portion of the compressor or turbine of a turbo machine such as a high performance gas turbine engine is schematically illustrated. A rotor disk 10 has a hub 12 extending axially parallel to the center line 14 of the gas turbine engine (not shown), a web 16 extending radially outwardly from the hub 12 and a plurality of dovetail posts 18 carried on the web 16. Conventionally, the rotor disk 10 and all its elements are annular in shape and support one or more circumferentially extending rows or banks of rotor blades 20, one row of which is partially illustrated in FIG. 1. Each rotor blade 20 comprises an air foil 22 having a blade tip, a platform 26 and a dovetail root 28.

The dovetail root 28 of each rotor blade 20 is axially slidable into the mating dovetail slot 30 formed by adjacent dovetail posts 18 of the rotor disk 10. With the rotor blades 20 in position as shown in FIG. 1, each one is held in place against movement both in a radial direction and in a tangential direction. The rotor blades 20 are not held against movement in an axial direction by the dovetail post 18.

As used herein, the term "radial" refers to a direction toward or away from the center line 14 of the rotor disk hub 12; e.g., "radially outwardly" denotes a direction away from the center line 14 and "radially inwardly" denotes a direction toward the center line 14. The term "axial" refers to a direction parallel to the longitudinal axis or center line 14. As viewed in FIGS. 2 and 3, the term "forward" refers to the lefthand side of such Figs., and the term "aft" refers to the righthand side of such Figs. The term "tangentially" as used herein refers to a direction perpendicular to the center line 14 extending into the plane of the paper.

Figure 3:
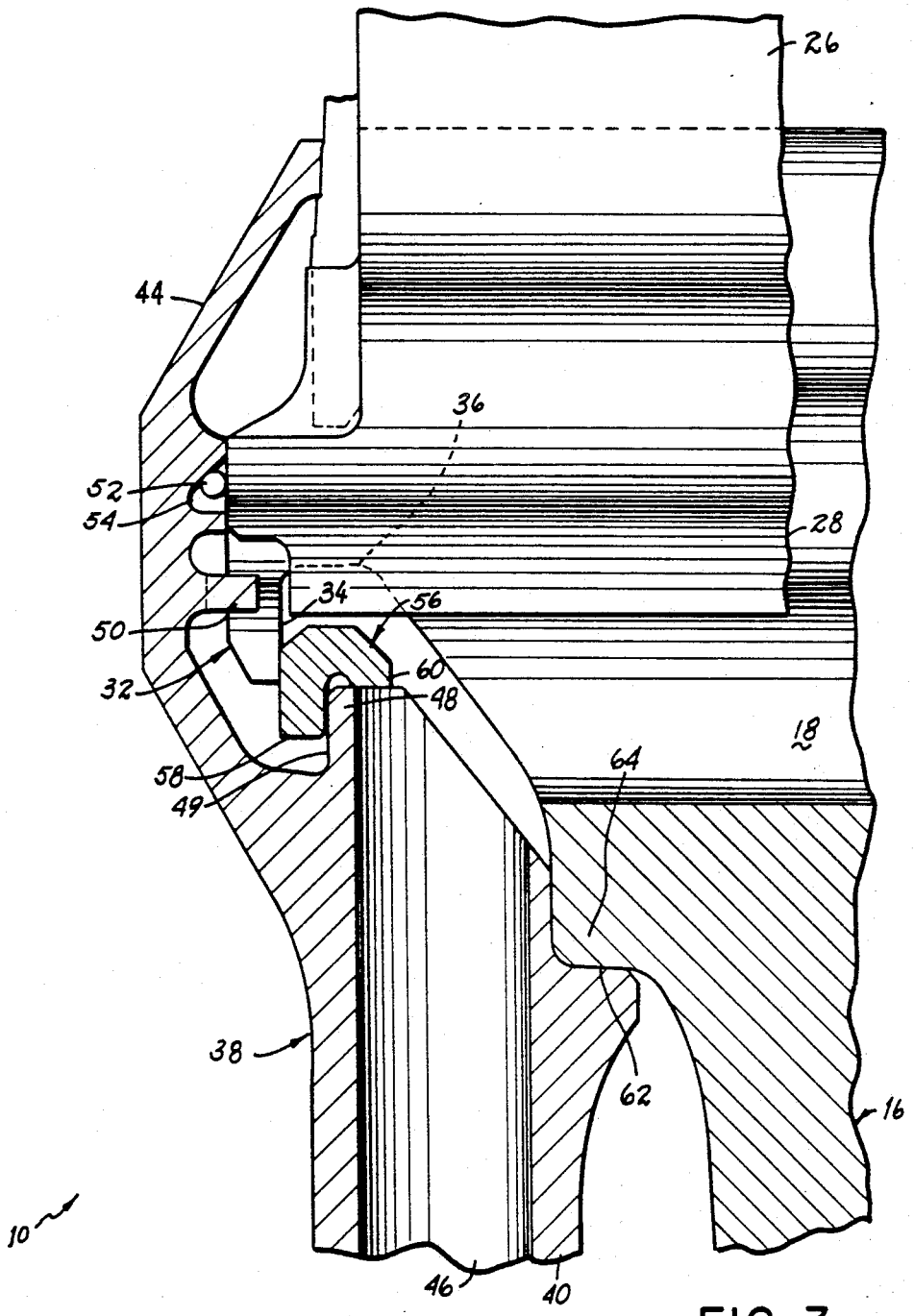
FIG. 3 is an enlarged view of a portion of FIG. 2.

Referring to FIGS. 2 and 3, one presently preferred embodiment of a retainer structure to prevent movement of the rotor blades 20 in a forward, axial direction is illustrated. The dovetail posts 18 of rotor disk 10 are each formed with a radially inwardly extending hook 32 having an aft surface 34. The hooks 32 are spaced from the body of the dovetail post 18 forming a cavity 36 therebetween.

In the embodiment of FIGS. 1–3, and FIG. 4, the dovetail posts 18 and rotor blades 20 are air cooled by a one-piece, annular impeller 38 carried on the rotor disk 10. The cooling function of the impeller 38 forms no part of this invention per se and is thus not discussed herein.

The impeller 38 has an inner end 40 mounted to a projection 42 formed on the web 16 of the rotor disk 10 and an upper end 44 which spans the dovetail slot 30 formed between adjacent dovetail posts 18. The particular structure for mounting the inner end 40 of impeller 38 to web 16 is described in more detail below. In the presently preferred embodiment, the impeller 38 is formed with a plurality of ribs 46, one of which is shown in FIGS. 2 and 3, which are adapted to direct a stream of cooling air radially outwardly to the dovetail posts 18 and rotor blades 20 to cool such elements. The impeller 38 is also formed with a radially outwardly extending flange 48 having a forward surface 49, and a number of tabs 50 spaced around the circumference of impeller 38, one of which is shown in FIGS. 2 and 3. With the impeller 38 in position relative to the rotor disk 10, the forward surface 49 of flange 48 faces the aft surface 34 of hook 32, and the tabs 50 contact the hooks 32 of dovetail posts 18 to prevent rotation of the impeller 38 relative to the rotor disk 10.

An annular, split seal ring 52 is carried in a groove 54 formed in the outer end 44 of impeller 38 which seats against the dovetail posts 18. This split ring seal 52 prevents leakage of cooling air moving along the impeller 38 radially outwardly past the rotor blades 20.

As best shown in FIG. 3, the outer end 44 of impeller 38 is mounted in an axially fixed position relative to the rotor disk 10 by a U-shaped retaining ring 56. The retaining ring 56 has a forward leg 58 and an aft leg 60, as viewed in the Figs., with the aft leg 60 being slightly shorter than the forward leg 58. In an assembly operation described in more detail below, the retaining ring 56 is movable to a seated, locked position, as shown in FIGS. 2 and 3, wherein the forward leg 58 is interposed between the aft surface 34 of hook 32 and the forward surface 49 of flange 48, and the aft leg 60 of retaining ring 56 rests atop the flange 48 of impeller 38.

In the seated, locked position of retaining ring 56, axial movement of the impeller 38 in a forward direction is prevented by engagement of the retaining ring 56 with the hook 32 of dovetail posts 18. Axial movement of the impeller in an aft direction is prevented by engagement of a notch 62 formed in the impeller 38 with a shoulder 64 formed on the web 16 of rotor disk 10, as well as the structure which mounts the inner end 40 of impeller 38 to the web 16 as described below. In turn, axial movement of the rotor blades 20 within the dovetail slots 30 formed by adjacent dovetail posts 18 is restrained in the forward, axial direction by the outer end 44 of impeller 38.

One important feature of this invention is that the retaining ring 56 is captured within the cavity 36 such that even if the retaining ring 56 should fail and break into two or more pieces it would nevertheless be likely to remain in place between the hooks 32 and flange 48 to effectively prevent forward axial movement of the impeller 38 and thus the rotor blades 20. As shown in the embodiment of FIGS. 1–3, the rotor blade 20 slides axially within the dovetail slot 30 and is spaced a short distance radially outwardly from the U-shaped retaining ring 56. The retaining ring 56 is therefore restrained from movement in a radial direction by the rotor blades 20, in the forward axial direction by the hooks 32 of dovetail posts 18 and in the aft axial direction by the flange 48 of impeller 38.

Figure 4:
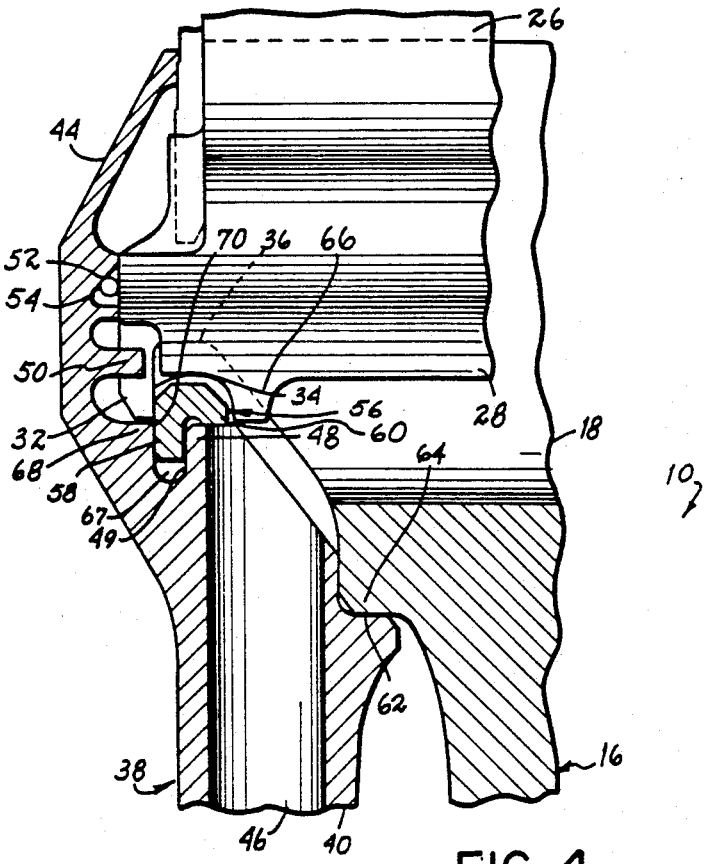
FIG. 4 is a view similar to FIG. 3 but of an alternative embodiment of this invention.

As shown in an alternative embodiment in FIG. 4, the retaining ring 56 can be further restrained or captured within cavity 36 by the provision of a radially inwardly extending tab 66 formed on the dovetail root 28 of rotor blades 20 and a slot 67 formed in the impeller 38. The tab 66 is located slightly aft of the aft leg 60 of retaining ring 56 to prevent aft, axial movement of the retaining ring 56 in the event of a failure. The slot 67 in impeller 38 is formed between the forward surface 49 of the flange 48 of impeller 38, and a shoulder 68 having an aft surface 70 facing the forward surface 49. The forward leg 58 of retaining ring 56 is received within the slot 67 thus restraining the retaining ring 56 axially and helping to hold it in place against the hooks 32 of dovetail posts 18 even if the retaining ring 56 should fail and break into two or more pieces. The remaining configuration of the embodiment shown in FIG. 4 is identical to that described in connection with FIGS. 1–3.

Figure 5:
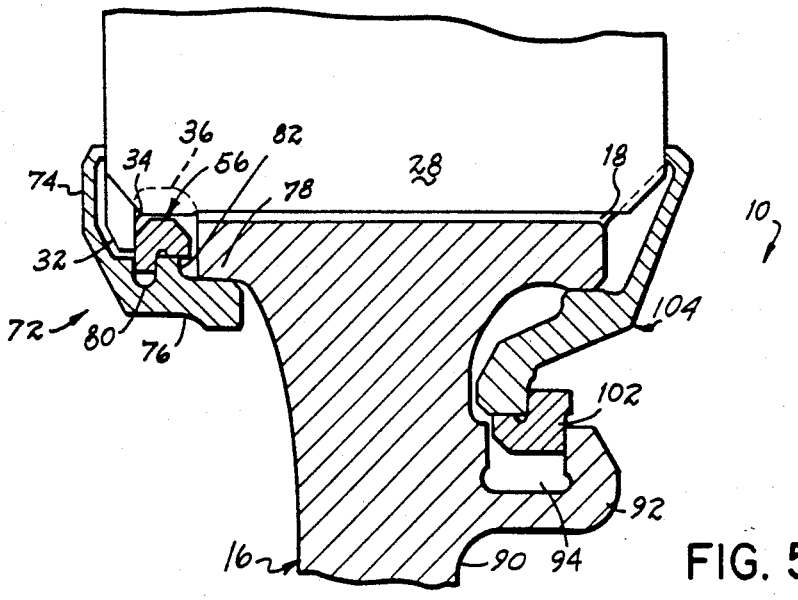
FIG. 5 is a view similar to FIGS. 3 and 4 of a still further embodiment herein.

Referring now to FIG. 5, an alternative embodiment of a blade retainer according to this invention is illustrated. In this embodiment, the impeller 38 is replaced with a blade retainer 72 particularly adapted for use with a rotor blade 20 which is not cooled with air passing through the gas turbine engine. The dovetail post 18, its hook 32 and the retaining ring 56 are identical in FIG. 5 to that shown in FIGS. 1–4. The blade retainer 72 is adapted to cooperate with such structure in the same manner as impeller 38, but is much lighter and smaller than the impeller 38.

The blade retainer 72 is generally L-shaped having an outer end 74 adapted to span the dovetail slots 30 between adjacent dovetail posts 18, and an inner end 76 which rests beneath a shoulder 78 formed in the web 16 of rotor disk 10. The blade retainer 72 is formed with a recess 80 and a radially outwardly extending projection 82. When mounted to the rotor disk 10 in the position shown in FIG. 5, the U-shaped retaining ring 56 is adapted to slide into the recess 80 of blade retainer 72 and wedge between the hooks 32 of dovetail posts 18 and the projection 82 of the blade retainer 72. In this position, the retaining ring 56 restrains the blade retainer 72 from forward axial movement relative to the rotor disk 10 and thus the outer end 74 of blade retainer 72 prevents axial movement of the rotor blades 20 in a forward direction.

Referring now to FIGS. 6A–6D, schematic drawings are provided illustrating the procedure for mounting the impeller 38 onto the rotor disk 10. The same procedure is employed in affixing the blade retainer 72 to the rotor disk 10.

Figure 6A:
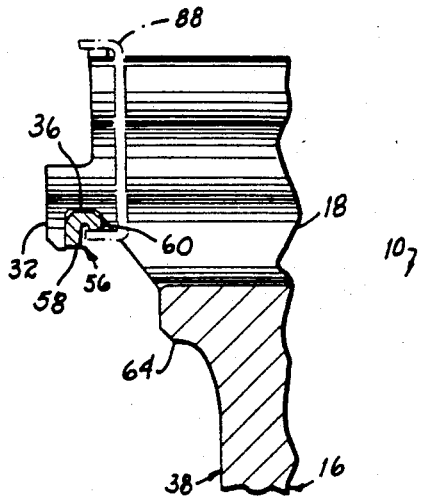
FIGS. 6A–6D are schematic, sequential steps of an installation operation employing the blade retainer structure of this invention.

As shown in FIG. 6A, the retaining ring 56 is first positioned entirely within the cavity 36 formed by the hook 32 of the dovetail posts 18. The retaining ring 56 is split, as at 86 in FIG. 1, so that it can be compressed and inserted within the annular cavity 36 formed by the row of circumferentially spaced dovetail posts 18. The forward leg 58 of retaining ring 56 is approximately equal to the length of the hook 32 in dovetail posts 18 so that it does not extend beyond the hook 32. Preferably, at least one clamp or wire 88 is positioned between the radially outer end of a dovetail post 18 and the bottom surface of aft leg 60 of retaining ring 56 to maintain the retaining ring 56 in position within cavity 36. Access of the wire 88 to the dovetail posts 18 and retaining ring 56 is provided through the dovetail slots 30.

Figure 6B:
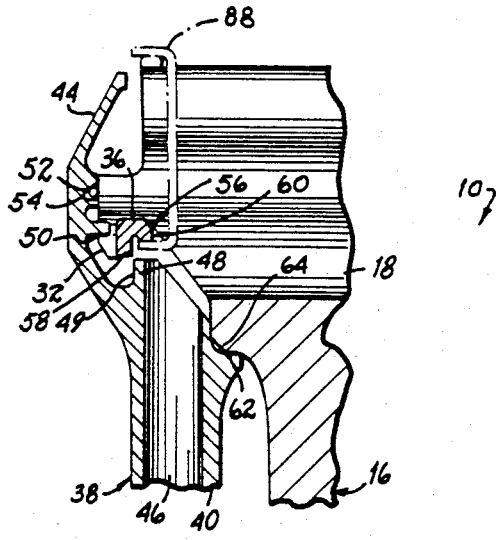

As shown in FIG. 6B, the next step in the assembly operation is to position the impeller 38 against the rotor disk 10 so that its outer end 44 spans the dovetail slots 30 formed by the dovetail posts 18, and its notch 62 rests against the shoulder 64 of web 16. As described in more detail below, the inner end 40 of impeller 38 is mounted to the projection 42 formed on the web 16. The tabs 50 at the outer end 44 of impeller 38 contact the hooks 32 and prevent the impeller 38 from rotating with respect to the rotor disk 10.

Figure 6C:
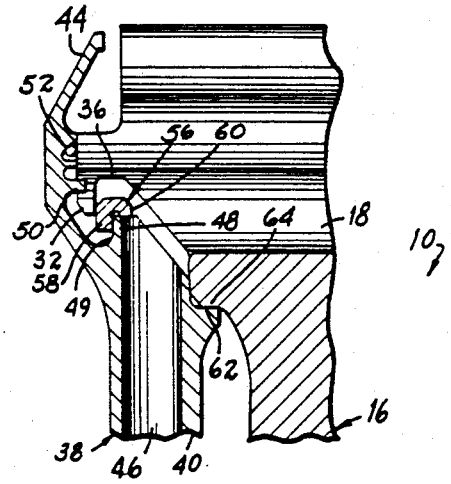

Referring now to FIG. 6C, the clamp or wire 88 is pulled in aft direction along a dovetail slot 30 to remove it and release the retaining ring 56. The retaining ring 56 is slid radially inwardly so that its forward leg 58 slides between the hooks 32 and flange 48. Radial inward movement of the retaining ring 56 is stopped by engagement of the bottom of the aft leg 60 with the flange 48 of impeller 38. In this seated, locked position of retaining ring 56, the impeller 38 is locked in a fixed, axial position with respect to the rotor disk 10 and blocks movement of the rotor blades 20 in a forward direction.

Figure 6D:
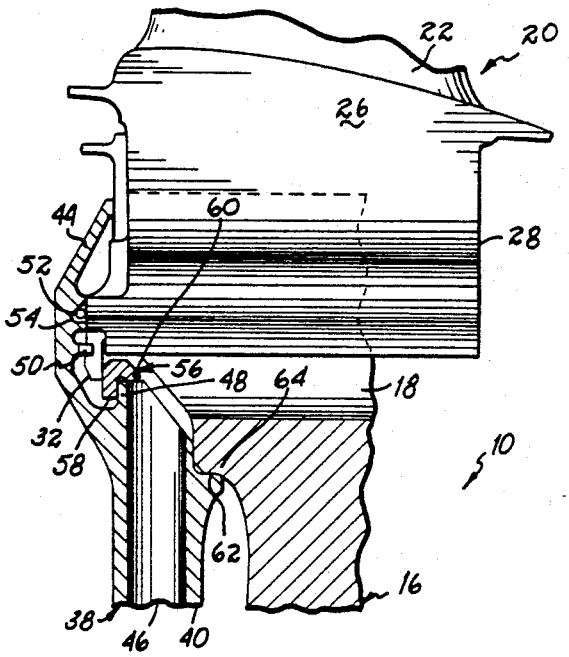

As shown in FIG. 6D, the rotor blades 20 are then slid in a forward, axial direction into the dovetail slots 30 of rotor disk 10 until the forward edge of the rotor blades 20 engages the impeller 38. In this position, the base or inner surface of the dovetail base or root 28 of rotor blades 20 is located radially outwardly from the retaining ring 56 if the retaining ring 56 is in a seated, locked position. This provides an effective, fail-safe means to ensure that the assembly operation described above in FIGS. 6A–6C has been done properly. In the event the retaining ring 56 has not been placed in a fully seated, locked positioned relative to the impeller 38 and/or dovetail posts 18, the inner portion of the dovetail root 28 would engage the retaining ring 56 and prevent insertion of the rotor blades 20 within the dovetail slots 30. Only with the retaining ring 56 in a seated, locked position can the rotor blades 20 be mounted to the rotor disk 10. Additionally, the rotor blades 20 prevent radial movement of the retaining ring 56 so that it remains in a locked position between the hook 32 and flange 48.

The foregoing discussion has been directed to securing the impeller 38, or the blade retainer 72, to the forward side of the rotor disk 10 so that forward axial movement of the rotor blades 20 is prevented. As shown in FIG. 2, retaining structure is also provided at the aft side of rotor disk 10 to prevent axial movement of the rotor blades 20 in an aft direction. This structure is disclosed and claimed in U.S. Pat. No. 4,304,523, assigned to the same assignee of this invention, which is incorporated by reference in its entirety herein Furthermore, this same structure is employed to mount the inner end 40 of impeller 38 to the projection 42 of rotor disk web 16.

The detailed construction of the aft blade retainer illustrated in FIG. 2 forms no part of this invention per se and reference should be made to U.S. Pat. No. 4,304,523 for a detailed discussion thereof. Briefly, the aft side 90 of the rotor disk web 16 is formed with an L-shaped arm 92 forming a cavity 94. An aft blade retainer 96 is positioned relative to the web 16 and dovetail posts 18 such that its outer end 98 spans the dovetail slots 30 and its inner end 100 extends radially inwardly to the cavity 94 formed by the L-shaped arm 92. An aft retaining ring 102 is carried within the cavity 94.

As described in detail in U.S. Pat. No. 4,304,523, the aft blade retainer 96 and aft retaining ring 102 are manipulated so that the aft retaining ring 102 slides in between the inner end 100 of aft blade retainer 96 and the L-shaped arm 92 of rotor disk web 16. In this position, the aft retaining ring 102 secures the aft blade retainer 96 in a fixed axial position with respect to the dovetail posts 18. In turn, the outer end 98 of aft blade retainer 96 prevents axial movement of the rotor blades 20 in an aft direction. The rotor blades 20 are thus captured between the impeller 38 and aft blade retainer 96.

As discussed above, this same structure is employed on the aft side of the rotor blades 20 in the embodiment of FIG. 5 and on the inner end 40 of impeller 38. In FIG. 5, a blade retainer 104 is mounted to the L-shaped arm 92 on the aft side of web 16 by an aft retaining ring 102 of the same type shown in FIG. 2 and disclosed in U.S. Pat. No. 4,304,523. Similarly, the lower end 40 is secured to the projection 42 on web 16 by a retaining ring 102 in the same manner disclosed above. See FIG. 2.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

We claim:

1. Apparatus for axially retaining rotor blades on a rotor disk having a hub, a web extending radially outwardly from said hub and rotor blade mounting posts carried on said web each having a body portion spaced from one another forming axial slots therebetween which mount said rotor blades, said apparatus comprising:

a radially inwardly extending hook formed on each of said rotor blade mounting posts, said hooks each having a first surface spaced from said body portion of said rotor blade mounting posts forming a cavity therebetween, said first surface facing in a first direction;

a blade retainer having an outer end engagable with said rotor blades, said blade retainer being formed with a flange having a second surface facing in a second direction opposite to said first surface of said hooks;

a retaining ring located within said cavity and being interposed between said first surface of said hooks and said second surface of said flange for securing said outer end of said blade retainer in an axially fixed position with respect to said rotor disk, said outer end of said blade retainer preventing axial movement of said rotor blades relative to said rotor disk.

2. The apparatus of claim 1 in which said flange of said blade retainer has an outermost edge, said retaining ring comprising a U-shaped element having a first leg connected to a second leg, said first leg being insertable between said first surface of said hooks and said second surface of said flange, said second leg being positionable atop said outermost edge of said flange.

3. The apparatus of claim 2 in which said first leg of said retainer ring is longer than said second leg thereof.

4. The apparatus of claim 2 in which the length of said first leg and the length of said second leg of said retainer ring are both shorter than the length of said hook formed in said rotor blade mounting posts.

5. The apparatus of claim 2 in which said rotor blades are each formed with an extension, said rotor blades being axially insertable within said axial slots formed between adjacent rotor blade mounting posts so that said extension faces said second leg of said U-shaped element to prevent axial movement of said U-shaped element.

6. The apparatus of claim 1 in which said outer end of said blade retainer is formed with spaced tabs which contact said hooks of said rotor blade mounting posts, said spaced tabs being effective to prevent rotation of said blade retainer with respect to said rotor disk.

7. The apparatus of claim 1 in which said retaining ring is split in at least one direction therealong forming spaced ends thereat.

8. Apparatus for axially retaining rotor blades on a rotor disk having a hub, a web extending radially outwardly from said web and rotor blade mounting posts carried on said web each having a body portion spaced from one another forming axial slots therebetween which mount said rotor blades, said apparatus comprising:

a radially inwardly extending hook formed on each of said rotor blade mounting posts, said hooks each having a first surface spaced from said body portion of said rotor blade mounting posts;

a blade retainer having a recess and an outer end engagable with rotor blades carried within said axial slots between adjacent rotor blade mounting posts;

a retaining ring insertable within said recess formed in said blade retainer in a position to contact at least a portion of said hooks on each of said rotor blade mounting posts, said retaining ring securing said outer end of said blade retainer in an axially fixed position with respect to said rotor blade mounting posts and said rotor disk, said outer end of said blade retainer preventing axial movement of said rotor blades relative to said rotor disk.

9. The apparatus of claim 8 in which said retaining ring is a U-shaped element having a first leg connected to a second leg, said first leg being insertable within said recess of said blade retainer and contacting at least a portion of said hooks on said rotor blade mounting posts.

10. The apparatus of claim 8 in which each of said rotor blades has a root formed with an extension, said root of said rotor blades being insertable within said axial slots formed between adjacent rotor blade mounting posts so that said extension of said roots is located adjacent said retaining ring.

11. Apparatus for preventing forward axial movement of rotor blades on a rotor disk having a hub, a web extending radially outwardly from said web and rotor blade mounting posts carried on said web each having a body portion spaced from one another forming axial slots therebetween within which said rotor blades are mounted, said apparatus comprising:

an annular, radially inwardly extending hook formed on each of said rotor blade mounting posts, said hook having an aft surface spaced from said body portion of said rotor blade mounting posts forming a cavity therebetween;

an annular impeller having an inner end adapted to mount to said web of said rotor disk and an outer end which engages an edge of the rotor blades carried in said axial slots between adjacent rotor blade mounting posts of said rotor disk, said impeller being formed with an annular flange having a forward surface which faces said aft surface of said hooks;

an annular retaining ring located within said cavity and being interposed between said aft surface of said hooks and said forward surface of said flange for securing said outer end of said impeller in a fixed axial position with respect to said rotor blade mounting posts and said rotor disk, said upper end of said impeller preventing forward axial movement of said rotor blades relative to said rotor disk.

12. The apparatus of claim 10 in which said retaining ring is split in at least one location therealong forming spaced ends thereat.

13. The method of retaining rotor blades on a rotor disk in a turbo machine from movement in a forward axial direction, comprising:

placing a retaining ring in a first, unlocked position within a cavity formed between a radially inwardly extending hook carried on each of the rotor blade mounting posts of the rotor disk and the body portion of said rotor blade mounting posts;

positioning a blade retainer having a flange against the web and rotor blade mounting posts of the rotor disk so that the flange faces the hooks carried on the rotor blade mounting posts and so that the outer end of said blade retainer is positioned to engage the forward edge of the rotor blades;

moving said blade retainer radially inwardly from said first, unlocked position to a second, locked position wherein said blade retainer is interposed between said hooks of said rotor blade mounting posts and said flange of said blade retainer to secure said blade retainer from movement in a forward axial direction relative to said rotor disk, said blade retainer preventing movement of said rotor blades in a forward axial direction.

14. The method of claim 13 in which said step of placing said retaining ring within a cavity comprises releasably securing said retaining ring to said rotor blade mounting posts with a clamp.

* * * * *